United States Patent [19]

Moloney

[11] 4,195,482

[45] Apr. 1, 1980

[54] STIRLING CYCLE MACHINE

[76] Inventor: John S. Moloney, 105 Claremone Ave., Kitchener, Ontario, Canada, N2M 2P7

[21] Appl. No.: 929,189

[22] Filed: Jul. 28, 1978

[51] Int. Cl.[2] ..... F02G 1/04

[52] U.S. Cl. ..... 60/517

[58] Field of Search ..... 60/517, 518, 519; 62/6

[56] References Cited

U.S. PATENT DOCUMENTS 4,010,611 3/1977 Zachery ..... 60/516

*Primary Examiner*—Allen M. Ostrager

*Attorney, Agent, or Firm*—Albert L. Jeffers

[57] ABSTRACT

A Stirling Cycle machine having a cylinder mounted in a housing has a displacer reciprocably mounted in the cylinder. Also reciprocably mounted in the cylinder is a piston and passages are provided in the cylinder so that when the displacer moves in one direction, a cooled gas will be drawn into the cylinder between the displacer and the piston, and when the displacer moves in the opposite direction, a heated gas will be drawn into the cylinder to thus provide expansive gas forces working against the piston thus causing the piston to be driven in its power stroke when the machine is utilized as an engine. The piston is drivingly connected to a crankshaft and the displacer is driven by a crankshaft, which is in rotative synchronism such that the displacer movement in the cylinder in the direction to draw heated air into the cylinder overlaps in time a substantial portion of the piston power stroke. The lengths of the connecting rods between each of the displacer and piston and their respective crank shafts are so proportioned to the respective crank throws that the displacer is so driven in its reciprocable cycle that it is provided with a long dwell within a given range of displacer movement near the end of displacer travel in the one direction which moves cold air into the cylinder and a relatively short dwell in the other direction which moves hot air into the cylinder. The piston dwell in a predetermined range of piston movement near the beginning of the power stroke is less than the piston dwell during the same predetermined range of piston movement near the end of the power stroke. Thus, a more efficient Stirling Cycle engine is provided.

11 Claims, 10 Drawing Figures

STIRLING CYCLE MACHINE

BACKGROUND OF THE INVENTION

This invention is in the field of hot-gas engines, or pumps, wherein a primary portion of the gas heating is done externally of the engine or pump, and is commonly referred to as a Stirling engine system named after the inventor, Robert Stirling, a Scottish minister.

Generally, the Stirling Cycle engine, or refrigeration machine, has a piston and displacer reciprocably mounted typically in the same cylinder. The displacer movement in one direction in the cylinder fills the cylinder with cool gas, referred to also as the working fluid, and displacer movement in the other direction in the cylinder filling the cylinder with heated working fluid. In the engine mode of operation, the heating is done externally of the cylinder and a regenerator through which the working fluid is pumped by the displacer, and which also is located externally of the cylinder, is utilized to cool the working fluid when the displacer moves in the one direction, and heat the working fluid passing through it when the displacer moves in the other direction. The piston is operatively connected to a crankshaft by means of a conventional connecting rod to drive the crankshaft when hot working fluid is drawn into the cylinder and its expansive forces move the piston in its power stroke. The displacer is drivenly connected to a crankshaft, by connection in conventional manner by a connecting rod, and operates in timed relation with the piston crankshaft to cause the working fluid to be drawn into the cylinder in a manner to drive the piston and its crankshaft. Since the external heating of the working fluid may be accomplished on a continuous basis, irrespective of the displacer and piston position in the cylinder, and is not confined to the cylinder in which the displacer and piston move, the operation of the engine can be essentially pollution free, can use any fuel, is quiet in operation, does not require a timed ignition system and may even be adapted to solar power operation. However, even with these advantages, and not withstanding considerable developmental effort by the industry, this engine has not found widespread use due to relatively low efficiencies. Examples of machines in the prior art are disclosed in the following U.S. Pat. Nos.:

| | |
|---|---|
| 723,660 | 3,688,512 |
| 2,616,247 | 4,004,421 |
| 2,775,876 | 4,010,611 |

and publications:

PHILIPS TECHNICAL REVIEW: Volume 20, 1958/59, No. 9 pp. 245–276, Article entitled—"The Philips Hot-gas Engine with Rhombic Drive Mechanism" by R. J. Meijer.

PHILIPS TECHNICAL REVIEW: Volume 31, 1970, No. 5/6 pp. 169–185, Article entitled—"Prospects of the Stirling Engine for Vehicular Propulsion" by R. J. Meijer.

ASME PUBLICATION: 61-WA-297, pp. 2–11, Article entitled—"Internally Focusing Solar Power Systems" by Theodor Finkelstein.

SAE Paper No. 949e, 1965 Annular Winter Meeting, Article entitled—"Philips Stirling Engine Activities" by R. J. Meijer.

SAE Paper No. 118c, 1961, Annual Winter Meeting, pp. 1 and 29 only, Article entitled—"Optimization of Phase Angle and Volume Ratio for Stirling Engines" by T. Finkelstein.

SUMMARY OF THE INVENTION

A Stirling Cycle engine having a common cylinder in which a displacer and piston are reciprocably movable, is provided with a first crankshaft which has a crank throw connected in a conventional manner by means of connecting rod to the displacer for reciprocably driving the displacer and a second crankshaft which has a crank throw connected in conventional manner by a connecting rod to drive the crankshaft when the system is operated as an engine. In this description, the system operation will be described for an engine but it is to be understood that the system may also operate as a refrigeration machine by driving the piston with the second crankshaft and external heat not being applied.

Heating tubes are connected to one end of the cylinder and admit heated working fluid to one end of the displacer, and cooling tubes are connected intermediately to the cylinder between the displacer and the piston to admit cooled fluid to the other end of the displacer facing the piston. A regenerator is placed between the heating tubes and cooling tubes and, as is conventional in the art, will cool the fluid when it is moved by the displacer from the heating tubes to the cooling tubes and will heat the fluid when it is moved by the displacer from the cooling tubes to the heating tubes. It is known that by effecting an "overlap" in the strokes of the displacer and piston so that displacer and piston strokes are in the same direction during a portion of the displacer stroke, a portion of the space traversed by the displacer being traversed also by the piston, that efficiency of the engine can be improved. During operation of the machine as an engine, heat is continuously added to the working fluid through the heating tubes, and removed at the cooling tubes. When operated as a refrigeration machine, the piston is reciprocated in the cylinder by an external power source and heat is absorbed by the working fluid and removed at the cooling tubes, with the "heating" tubes becoming refrigerated. The working fluid may be air, hydrogen, helium, or other suitable medium.

It has been found that a more efficient engine is possible when the displacer is able to hold the working fluid in the cylinder space between the displacer and the piston for substantially the entire compression stroke of the piston and then move in the cylinder to cause the heated fluid to be admitted to the upper space of the cylinder during substantially the entire expansion or power stroke of the piston. During this time, the displacer and the piston would be moving in the same direction in the cylinder resulting in the aforementioned "overlap", resulting in a larger volume of the cylinder being swept by the piston during each stroke. Then, it is desirable to have the displacer, at the completion of the expansion stroke of the piston, move in the other direction in the cylinder to cause the cooler working fluid to be admitted to the cylinder and at this time maintain the piston at the bottom of its expansion stroke until the cylinder is completely filled with the cooler fluid so that when the piston moves in its compression stroke the cylinder will be substantially filled with the cooler fluid, requiring less work to move the piston in its compression stroke thus increasing the efficiency of the machine.

To achieve this higher efficiency engine, it is desirable to increase the dwell of the displacer near the end of its stroke after moving cooler fluid into the cylinder, and decrease the dwell of the displacer at the end of its stroke after admitting heated fluid into the cylinder. Also, in conjunction with the foregoing, it is desirable to decrease the dwell of the piston movement at the end of its compression stroke and increase the dwell of the piston movement at the end of its expansion or power stroke. This invention teaches the manner of obtaining the aforedescribed movements in a practical engine. The manner in which these movements are achieved in the disclosed preferred embodiment comprise synchronizing the movements of the displacer and piston crankshafts, in a 1:1 rotative relationship, with means to adjustably rotatively position one crankshaft relative the other where separate crankshafts are used to adjust the cyclical phase therebetween; means to adjust the overlap of the displacer and piston strokes; means for establishing the length of the piston stroke independently from that of the displacer stroke; means for obtaining a predetermined relationship between the "dwell" at the beginning and ending of the stroke; of each of the piston and displacer. The phasic relation, or lead or lag, between the displacer cyclic motion and the piston cyclic motion, commonly referred to as advance or retard timing angle adjustment, is obtained by changing or adjusting the relative rotative position between the displacer crankshaft and the piston crankshaft. This is obtained in the preferred embodiment by placing a sprocket wheel on each of the crankshafts with a timing chain entrained over the sprockets to cause the crankshafts to rotate in a 1:1 relation. The sprocket wheel on at least one of the crankshafts, preferably the displacer crankshaft, is rotatably releasable, rotatively adjustable, and lockable to the crankshaft so that the relative rotational position between the crankshafts may be adjusted to accomplish the aforementioned desired lead or lag between the displacer and piston motions.

Further, this invention provides means for adjusting the ratio of "dwells" at the ends of each of the piston and displacer strokes and varying the respective stroke lengths by varying the length of the crank throw. By changing the respective ratio of connecting rod to crank throw, the desired dwell ratio for each is obtained. Both the sprocket wheel rotative position relative to its crankshaft and the connecting rod crank throw ratios may be changed to suit a desired application so that one machine can be adapted for a variety of design applications. Thus, a Stirling machine is provided wherein a more efficient cycle is possible and certain parameters, such as ratio of dwell of the piston and displacer, and lead and lag between the piston and displacer cyclic motions, can be adjusted in a relatively simple and inexpensive manner which does not require a machine redesign.

Therefore, it is an object of this invention to provide a Stirling Cycle machine having a higher efficiency.

It is another object of this invention to provide in the machine of the previous object means for adjusting the phasic relation, or lead and lag, between the displacer and piston cyclic motions.

Another object of this invention is to provide means for adjusting the extent of overlap of displacer and piston strokes.

It is a further object of this invention to provide in the machine of the previous objects means for adjusting the ratio of dwell at each end of each of the piston and displacer strokes, and the length of the strokes, to obtain the desired volumetric characteristics in machine operation.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

A prior art machine and two preferred embodiments of this invention are disclosed and described. In the prior art machine, disclosed in FIGS. 1 and 1A, a machine is shown wherein the displacer and piston are connected to a common crankshaft. In the first embodiment shown in FIGS. 5 and 6, the displacer and piston are shown connected to separate crankshafts with the displacer crankshaft passing through the body of the displacer; and in the second preferred embodiment shown in FIG. 7, the displacer and piston are shown connected to separate crankshafts with the displacer crankshaft being above the displacer.

Figure 1:
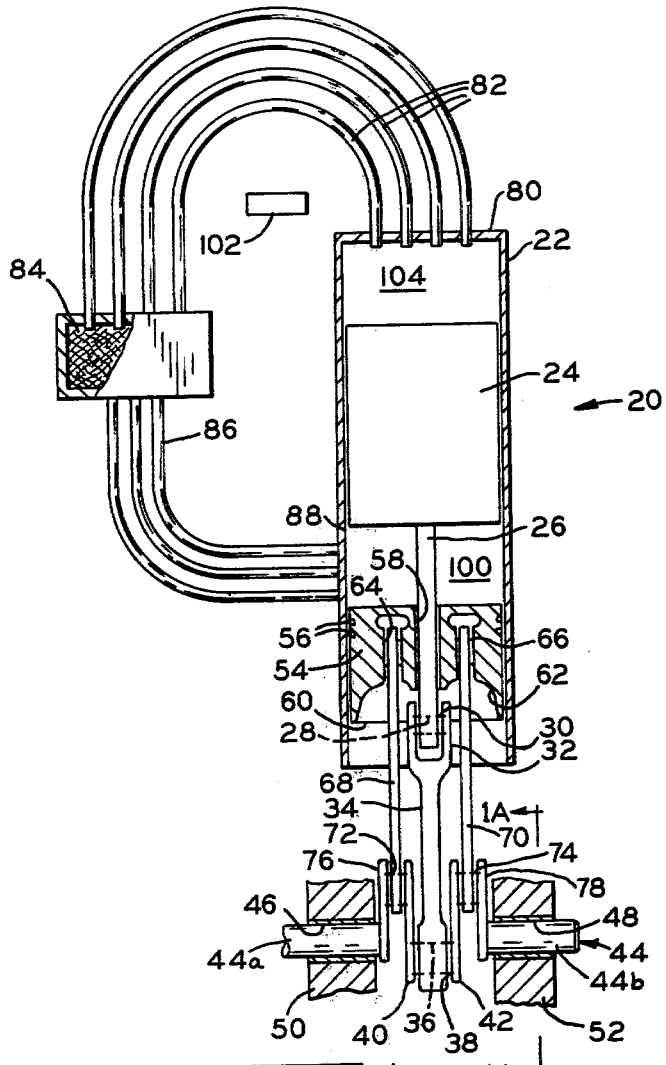
FIG. 1 PRIOR ART
FIG. 1 is a sectioned, partial, diagrammatic view of a prior art machine.
Figure 1A:
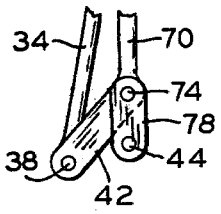
FIG. 1A is a partial section taken at 1A—1A of FIG. 1.

Referring to FIGS. 1 and 1A, a Stirling Cycle machine 20 has a cylinder 22 in which a displacer 24 is reciprocably movable. An elongated extension shaft 26 is affixed centrally to the underside of displacer 24 and has a transverse opening 28 at the lower end thereof for journaling pin 30 affixed at each end to bifurcated arms 32 of elongated connecting rod 34. Rod 34 has a transverse opening 36 at the end thereof for journaling crank pin 38 affixed at each end to webs 40, 42 respectively which, as will become apparent, are rotatable by common crankshaft 44 journaled for rotation in openings 46 and 48 in crankcase walls 50, 52 respectively in conventional manner and with conventional seals.

A piston 54 is reciprocable in cylinder 22 and has piston rings 56 mounted in corresponding grooves in its outer walls in conventional manner, with rings 56 sealingly and slidably engaging the inner walls of cylinder 22 as piston 54 reciprocably moves in cylinder 22. Piston 54 has a cylindrical opening 58 which sealingly and reciprocably receives shaft 26. Piston 54 has a pair of bell-shaped cavities 60, 62 which have pins 64, 66 affixed adjacent the upper ends thereof. Pins 64 and 66 are journaled respectively in transverse openings in the upper ends of elongated connecting rods 68, 70 which have openings in their lower ends for journaling, respectively, pins 72, 74. The ends of pin 72 are affixed respectively to crank webs 76 and 40 and the ends of pin 74 are affixed respectively to crank webs 42 and 78. Webs 76 and 78 are affixed to, respectively, and rotate with, sections 44*a* and 44*b* of crankshaft 44. Thus, it is seen that when crankshaft 44 rotates, webs 76, 40,42 and 78 rotate therewith. As is understood in the art, reciprocation of piston 54 in cylinder 22 operates through pins 64, 66, rods 68, 70, pins 72, 74, to rotate crankshaft 44 when machine 20 is operating as an engine, and conversely, when machine 20 is operating as a refrigeration machine, rotation of shaft 44 will cause reciprocation of piston 54 in cylinder 22.

Prior to a discussion of FIGS. 3 and 4, the operation of a conventional prior art Stirling Cycle system will be described in conjunction with FIG. 2.

In fluid communication with the upper surface 80 of cylinder 22 are the first ends of a plurality of heat tubes 82, the other ends of which are in fluid communication with a regenerator 84. The regenerator 84 is of a type well known in the art, and is adapted to provide highly efficient heat transfer to gases flowing therethrough and for example may comprise fine interlacing metal wires or strips, or alternatively, layers of steel wire screening, or coarse metal wool forming a thick pad or mat. In fluid communication with the lower side of regenerator 84 are the first ends of a plurality of cooling tubes 86, the other ends of which are in fluid communication with an intermediate point in wall 88 of cylinder 22. The operation of a conventional, prior art hot air, or Stirling Cycle engine will now be described with the aid of the plot in FIG. 2.

Figure 2:
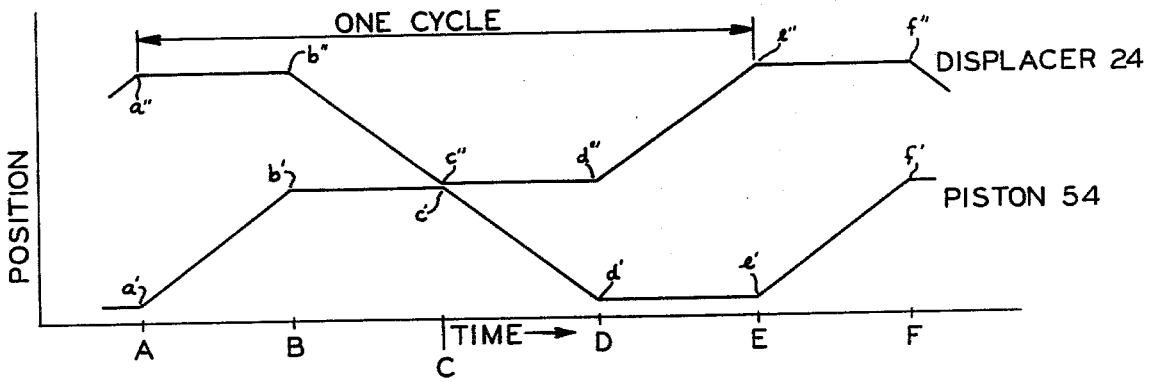
FIG. 2 PRIOR ART
FIG. 2 is a theoretical position-time plot of the phasic relation between a displacer and piston in a conventional Stirling Cycle engine.

Assuming that the piston and displacer are at time A in FIG. 2, it is seen that the piston position at time A is a′, or is at its lowermost position, and the displacer position is at a″, or at its uppermost position. At time A, the maximum amount of cooled fluid is in cylinder 22, in the space 100 between the displacer 24 and piston 54, and in tubes 86. Space 100 at this time is at its maximum. As time moves to point B, the displacer 24 remains, or "dwells" at substantially the same position, and in the theoretical plot of FIG. 2 the position b″ of displacer 24 is the same as position a″, but piston 54 is moving from position a′ to its uppermost position b′. However, since cooled gas is in space 100, the work required to move piston 54 from position a′ to b′ is relatively small. During the time period between B and C, piston 54 remains or "dwells" at approximately the same position, positions b′ and c′ being the same in the theoretical plot of FIG. 2, while displacer 24 moves from position b″, its uppermost position, to position c″ its lowermost position.

During this downward movement of displacer 24, the cool air in space 100 is forced through tubes 86 and through regenerator 84 where it is heated and, with machine 20 acting as an engine, heat is applied by source 102, which may be any conventional burner and may use any fuel. The combustion environment is controllable for production of a minimum of pollutants, and tubes 82, which may be of copper or other heat conductive material, readily heat the working fluid thereof, which may be air, hydrogen, helium, or other suitable fluid. The heated fluid is drawn into the upper end 104 of cylinder 22. At this time in the cycle, the maximum volume of the working fluid has been heated and has increased in pressure. During the time period between C and D, displacer 24 dwells at approximately the same position c″-d″, while piston 54 is forced by the expanding working fluid from position c′ to d′ in its expansion or power stroke, thus turning crankshaft 44. In the time period D to E, piston 54 dwells between position d′ and e′, its lowermost level, while displacer 24 is moving from position d″ to e″, its lowermost position to its uppermost position, again filling the working fluid space with a maximum amount of cool air since movement of displacer 24 upwardly forces working fluid through tubes 82, regenerator 84 where the fluid is cooled, and into tubes 86 where it is further cooled and space 100. The work done is measured by the difference in fluid temperature between the heated working state and cooled working state, and between the relative positions of displacer 24 and piston 54 throughout the cycle.

Figure 3:
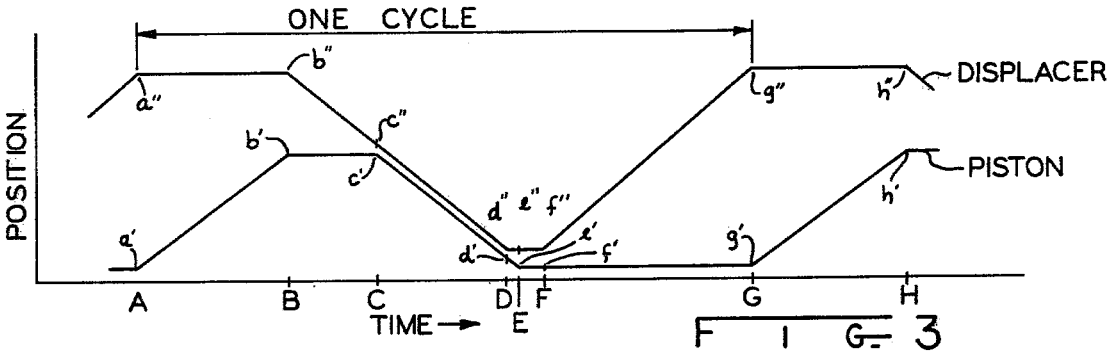
FIG. 3 is a theoretical position-time plot of the phasic relation between a displacer and piston in a preferred embodiment of this invention.
Figure 4:
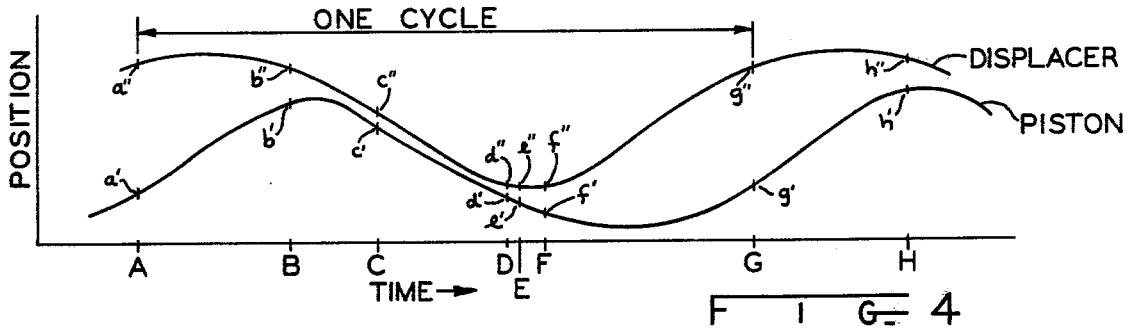
FIG. 4 is a practical position-time plot of the phasic relation between a displacer and piston of a preferred embodiment of this invention.

This invention teaches that by properly selecting the length ratio of the connecting rod and crank throws of both the displacer and the piston, and by properly positioning the piston and displacer pins relative their respective crankshafts, and by adjusting the relative rotative positions between the displacer throw arm and the piston crank throw arm, the theoretical plots shown in FIG. 3 may be practically achieved as shown in the plots in FIG. 4. Referring to FIG. 3, at time A, the piston 54 is at its lowermost position a′ and the displacer 24 is at its uppermost position a″. At time B, piston 54 has moved to its uppermost position b′ while displacer 24 has dwelled at or near its uppermost position b″. At time C, piston 54 is at position c′ and displacer 24 is at position c″, the piston 54 during the time period B–C has dwelled at its uppermost position and displacer 24 has started its downward movement and at time C displacer 24 is just above piston 54. At time D, piston 54 is near its lowermost position and is at position d′ while displacer 24 is at its lowermost position d″. During the time period C–D, displacer 24 and piston 54 are both moving downwardly at the same rate and thus during this portion of their cycles their movement is "overlapping".

At time E, piston 54 is at its lowermost position e′, and displacer 24 is at its lowermost position e″, and during the time period D–E, piston 54 has completed its downward travel to its lowermost position.

At time F, piston 54 is at its lowermost position f′, and displacer 24 is at its lowermost position f″. During the time period E–F, displacer 24 and piston 54 have dwelled at their lowermost positions. At time G, piston 54 is still at its lowermost position g′ while displacer 24 is at its uppermost position g″. During the time period F–G, piston 54 has continued its dwell at its lowermost position while displacer 24 has moved upwardly to its uppermost position, drawing cooler working fluid into the cylinder space 100 and causing the heated fluid from tubes 82 to flow through, and be cooled by, regenerator 84 and tubes 86. At time H, piston 54 has risen to its uppermost position h′, and displacer 24 has continued at its uppermost position h″. In the time period G–H, piston 54 has moved from its lowermost position g′ to its uppermost position h′, compressing the cooled fluid in cylinder space 100, and displacer 24 has continued at its uppermost position g″–h″.

In the plots of FIG. 3, it is important to note that for displacer 24 positions, the dwell position a''-b'' at the top of the displacer 24 stroke, is substantially longer than the dwell period d''-f'', at the bottom of the displacer 24 stroke. Similarly, for piston 54 positions, it is important to note that the dwell position b'-c' at the top of the piston 54 stroke is substantially shorter than the dwell position e'-g' at the lowermost or bottom of the piston 54 stroke. Also, in the piston 54 expansion or power stroke as shown by line c'-e', during substantially all of that power stroke, the displacer 24 is also moving downwardly, overlapping the power stroke, drawing in heated expanding gas into the cylinder space 100 to improve the power output of the machine 20. This invention provides for a mechanical adjustment of the machine 20 parts to achieve the practical equivalent of the desirably efficient theoretical curves of FIG. 3. By increasing or decreasing the ratio of the effective connecting rod length, that length being the distance between the center lines of the pins which are journaled in opposite ends of the rod, to the crank throw, that being the distance between the center lines of the pins journaled in opposite ends of the crank web connected to the rod, the desired relative dwell periods may be achieved as illustrated in the practical plot shown in FIG. 4 with the letter designations in FIG. 4 corresponding to those of FIG. 3 and with the above explanation for FIG. 3 applying to FIG. 4 and its letter designations. In general, by decreasing the connecting rod:crank throw length ratio, the dwell ratio at opposite ends of the stroke is changed. In other words, as the crank throw length approaches the connecting rod length, the dwell period at the end of the stroke wherein the crank throw and the connecting rod are superimposed, FIG. 6A, is much greater than the dwell period at the end of the stroke wherein the connecting rod is extended from the crank throw, FIG. 6B. In a preferred embodiment the connecting rod:crank throw ratio is 2.346 for the displacer and 2.542 for the piston. The approximate range of ratios for the displacer is 1.75 to 4 and the approximate range of ratios for the piston is 1.625 to 4.

Also, a preferred ratio of top displacer dwell (100°) to bottom displacer dwell (40°) is approximately 2.5:1 and a preferred ratio of bottom piston dwell (100°) to top piston dwell (40°) is approximately 2.5:1.

Further, the degree of overlap between the displacer stroke and the piston stroke may be controlled by varying the rotative position of the crank web for the displacer connecting rod and the rotative position of the crank web for the piston connecting rod, while at the same time making a suitable change in the distance between the center lines of the two crank shafts, bringing them closer together or farther apart. In a preferred embodiment the displacer web leads the piston web by 75 degrees, with a preferred range of rotative position being between 40 degrees to 105 degrees, of displacer web lead over piston web rotative position.

Figure 6:
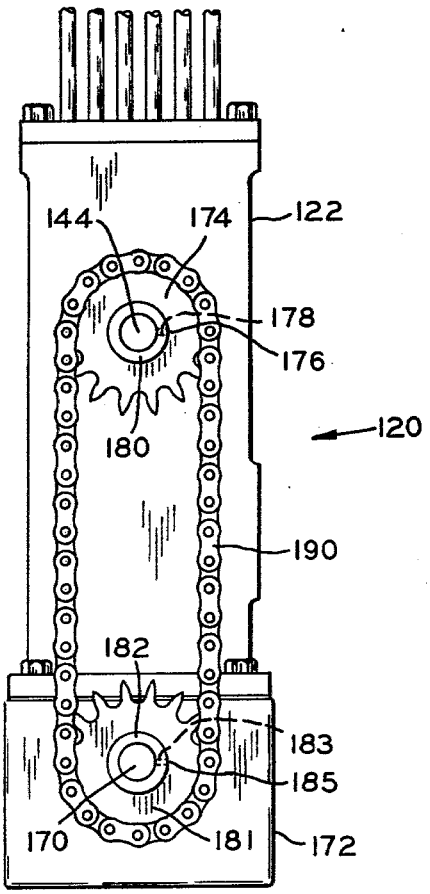
FIG. 6 is a view of the embodiment of FIG. 5 showing the sprocket wheels mounted to the crankshafts and with a common chain entrained over the wheels.
Figure 6A:
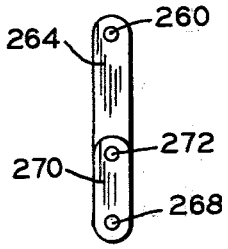
FIG. 6A is a diagrammatic view showing the connecting rod and crank web in overlapping position.
Figure 6B:
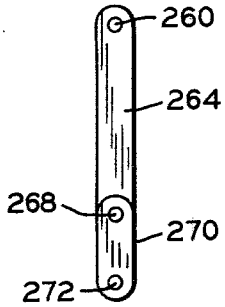
FIG. 6B is a diagrammatic view showing the connecting rod and crank web in extended position.
Figure 7:
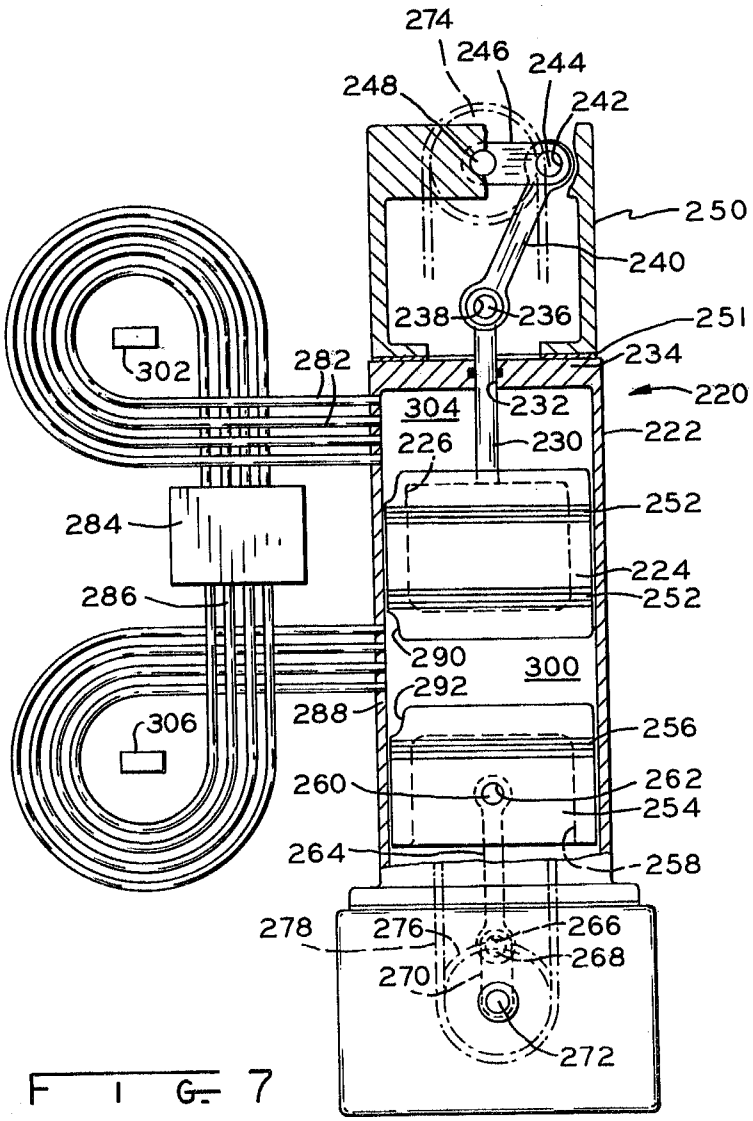
FIG. 7 is a sectioned, partial, diagrammatic view of a second preferred embodiment of this invention.
Figure 5:
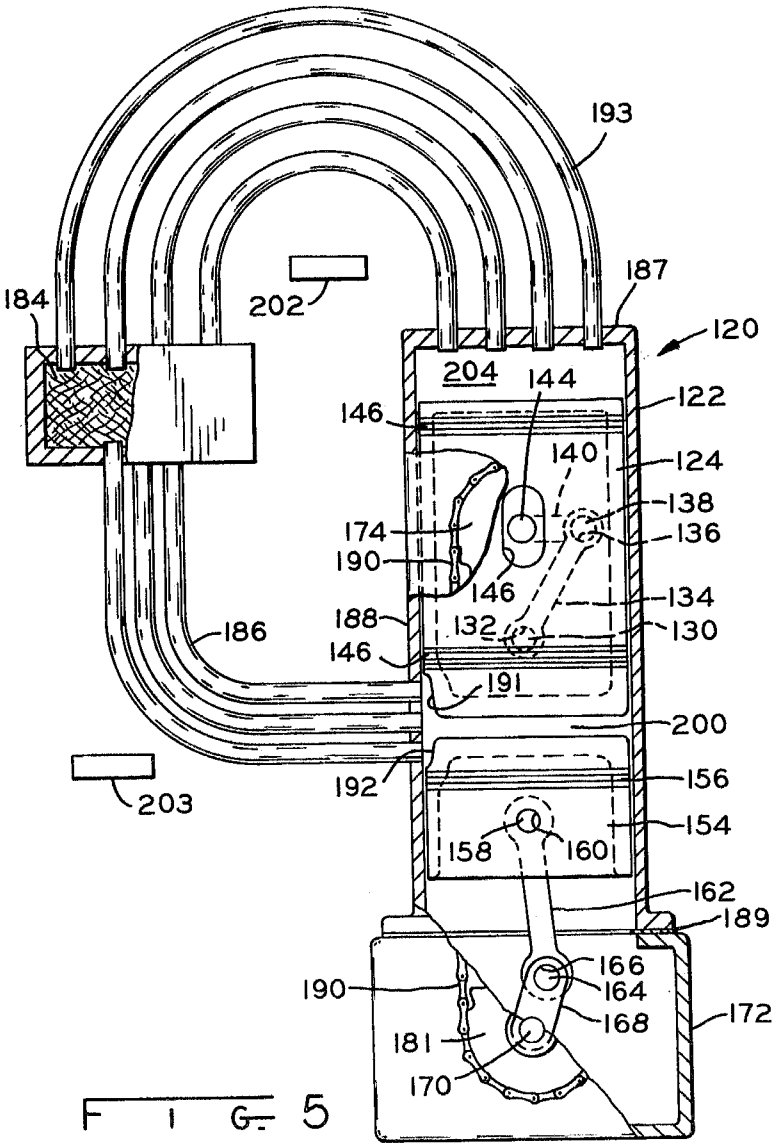
FIG. 5 is a sectioned, partial, diagrammatic view of a first preferred embodiment of this invention.

In the embodiments of FIGS. 5 to 7, separate crankshafts are used for the displacer and piston, with each crankshaft having a sprocket wheel attached thereto and with a common chain entrained over the sprocket wheels so that the crankshafts are caused to move in synchronism in a 1:1 ratio with the wheel on at least one of the shafts being releasably lockable to the shaft so that the relative rotative positions of the wheels, and hence the shafts, may be adjusted as desired and the distance between the crankshafts may also be adjusted as desired, to effect the proper degree of lead or lag, and overlap, between the strokes of the displacer and the piston.

Referring now to the embodiment of FIGS. 5 and 6, a cylinder 122 reciprocably supports a displacer 124 therein which carries in fixed position at the lower end thereof a pin 130 journaled in opening 132 at one end of connecting rod 134. The other end of rod 134 has an opening 136 in which is journaled a pin 138 affixed to one end of crank web 140. The other end of web 140 is affixed to crankshaft 144 mounted for rotation in the walls of cylinder 122, with appropriate and conventional pneumatic seals surrounding the shaft ends to prevent the escape of working fluid from cylinder 122. An elongated slot 146 is formed in each side of displacer 124 and shaft 144 extends through slots 146. The length of slots 146 in the axial direction is sufficient to permit free movement of displacer 124 axially in cylinder 122. As will be apparent to those skilled in the art, rotation of shaft 144, and rotation of web 140, through the connection of rod 134, will cause displacer 124 to reciprocate in cylinder 122. Rings 146 are placed about the upper and lower portions of displacer 124, in a manner known to the art to provide a sliding sealing engagement with the walls of cylinder 122.

A hollow piston 154 is also mounted for reciprocal movement in cylinder 122 and has provided thereabout piston rings 156 which fit in corresponding grooves on piston 154 and are in sliding, sealing engagement with the walls of cylinder 122, in a manner well known to the art. A pin 158 is affixed at either end to the walls of piston 154 and is journaled in opening 160 at one end of connecting rod 162. The other end of rod 162 has an opening 166 in which is journaled a pin 164, pin 164 being affixed at one end to crank web 168. The other end of web 168 is affixed to crankshaft 170 and rotates therewith. Shaft 170 is journaled for rotation in crankcase 172, by means not shown but well known and conventional in the art, and when the machine 120 is operated as an engine, shaft 170 drives an output load, not shown.

Referring now particularly in FIG. 6, exteriorly of cylinder 122, a first sprocket wheel 174 is mounted on and releasably lockable to crankshaft 144. The manner of locking wheel 174 to shaft 144 is by means of set screw 176, which is threadedly mounted in hole 178 on annular boss 180 which is affixed centrally of wheel 174 and extends axially from the side thereof and snugly receives shaft 144. By means of set screw 176, wheel 174 may be drivenly affixed to shaft 144. Screw 176 may be screwed out of hole 178 releasing shaft 144 so that wheel 174 may be rotatively moved relative to shaft 144 and thus adjust the lead or lag between displacer 124 and piston 154, as will be more fully explained. After the proper rotative adjustment has been made between wheel 174 and shaft 144, set screw 176 is retightened in hole 178 to bear against shaft 144 and rotatively lock wheel 174 and shaft 144. Other means, well known to the art, may be used for providing a releasable lock mount of wheel 174 on shaft 144.

In similar manner, sprocket wheel 181, which is identical to wheel 174, is releasably lock-mounted to shaft 170 exteriorly of cylinder 122 and wheel 181 is coplanar with wheel 174. An annular boss 182 is affixed centrally to wheel 181 and extends axially therefrom and carries a hole 183 in which is threadedly mounted set screw 185 which may be tightened against shaft 170 to rotatively lock wheel 181 to shaft 170. A chain 190 is entrained over the sprockets of wheels 174 and 181, providing a 1:1 driving relation between shafts 170 and 144 to fix their rotative positions relative one another and thus fix the relative longitudinal positions of displacer 124 and piston 154 in cylinder 122. While both wheels 174 and 181 are shown releasably lock-mounted to their respective shafts 144 and 170, in order to provide the desired relative rotational adjustment between shafts 144 and 170, only one wheel 174 or 181 need be releasably lock-mounted to its respective shaft, and preferably, it is the wheel that is mounted to the displacer shaft 144. Also, it is preferable that an anti-backlash device, and chain slack adjustment member, such as a spring-mounted idler wheel well known in the art, or other similar means for accomplishing this purpose, be utilized to remove slack and backlash from chain 190 so that the relative rotational positions of shafts 144 and 170 may be accurately controlled and maintained.

Referring now to FIG. 5, heating tubes 193, similar in construction and function to tubes 82 in the embodiment of FIG. 1, are shown mounted in fluid communication with the upper surface 187 of cylinder 122 of machine 120. The other ends of tubes 193 are in fluid communication with regenerator 184, similar in construction and function to regenerator 84 of the embodiment of FIG. 1, and first ends of cooling tubes 186 are in fluid communication with regenerator 184 and the other ends of cooling tubes 186 are in fluid communication with an intermediate portion of wall 188 of cylinder 122. Displacer 124 and piston 154 are relieved respectively at 191 and 192 in order to provide clearance for fluid transfer between the space 200 in cylinder 122 and tubes 186. A heat source 202 is provided to tubes 193 and a cooling means 203 is provided to tubes 186, when machine 120 is used as an engine. Space 200 is formed in cylinder 122 between displacer 124 and piston 154 and space 204 is formed in cylinder 122 between upper surface 187 and the upper surface of displacer 124.

In the operation of the embodiments of FIGS. 5 and 6, the displacer 124 and piston 154 follow the position-time plots of FIG. 4. At time A piston 154 is at position a′, which is in a predetermined positional range, or dwell, at the low end of the piston 154 stroke and displacer 124 is at a″ in a predetermined positional range, or dwell, at the upper end of displacer 124 stroke. At time B, piston 154 has moved to position b′, within a predetermined positional range at the upper end of piston 154 stroke and displacer 124 is at position b″ which is in a predetermined positional range at the upper end of displacer 124 stroke. During the time period A–B, piston 154 is moved in its compression stroke, compressing cool working fluid in space 200 in cylinder 122. As mentioned, the work done by piston 154 in compressing the cooler gas is relatively small.

At time C, piston 154 is at position c′, which is within a predetermined range at the top of the piston 154 stroke, and displacer 124 is at position c″, having moved downwardly and drawing the heated working fluid in pipes 193, which is heated by burner 202, into space 204, with the cooler gas being drawn from space 200 through tubes 186 into and through regenerator 184 where it is preheated prior to the final heating by burner 202. During the time period B–C, piston 154 dwells in its predetermined positional range and displacer 124 has moved downwardly as previously explained.

At time D, piston 154 has moved to position d′ near the end of its expansion or power stroke and displacer 124 has moved to position d″ which is within a predetermined positional range at the completion of its stroke drawing heated working fluid into space 204 of cylinder 122. Thus, during the time period C–D, piston 154 has gone through substantially all of its expansion or power stroke when machine 120 is being operated as an engine. At time E, piston 154 is at position e′, beginning its predetermined positional range near the bottom of its stroke, and displacer 124 is at position e″, within its predetermined positional range at the bottom of its stroke. At time F, piston 154 is within its predetermined positional range at the bottom of its stroke and displacer 124 is completing its predetermined positional range at the bottom of its stroke and beginning upon its stroke to draw cooled working fluid into space 200 prior to the compression stroke of piston 154. At time G, piston 154 has completed its predetermined positional range near the bottom of its stroke and is at position g′ and displacer 124 is at position g″ and beginning its predetermined positional range at the top of its stroke. During time F–G, displacer 124 has drawn cooled working fluid into space 200 through pipes 186 and has forced the heated working fluid in space 204 into pipes 193 and through regenerator 184 where the fluid is cooled. At time H, piston 154 is at position h′ and has completed its compressive stroke, corresponding to position b′, and displacer 124 has completed its movement in a predetermined positional range. In this description, the term "dwell" signifies the predetermined positional ranges defined in FIG. 4 for displacer 124 between positions a″–b″, and d″–f″; and for piston 154 the predetermined positional ranges b′–c′, and e′–g′. It is seen that the center of each dwell period is top dead center or bottom dead center of each of the displacer or piston cycles.

The positional overlap in the displacer and piston curves in FIG. 4, which is substantially that part of the displacer plot between c″–d″ and of the piston plot between c′–d′, can be adjusted by causing crankshaft 144 to move closer to or farther away from crankshaft 170, which in turn can be done by unbolting cylinder 122 from crankcase 172, raising or lowering cylinder 122 as desired, replacing spacer 189 by another spacer of the required thickness, and rebolting cylinder 122. A rotational adjustment of shaft 144 should be made at the same time by loosening set screw 176, rotating shaft 144 while holding shaft 170 stationary, until the desired rotational relation between shafts 144 and 170 has been achieved, after which set screw 176 will be retightened against shaft 144. The ratio between the dwell time at the top of the displacer stroke to the dwell time at the bottom of the displacer stroke can be adjusted by selecting a connecting rod 134 which has an effective length relative the effective length of web 140 to achieve the desired dwell time ratio. In this regard, as the ratio between the length of rod 134 as compared to the length of web 140 is lowered, the larger the ratio of dwell between positions a″–b″ to the dwell between positions d″–f″ of displacer 124. Also, the smaller the ratio between effective length of rod 162 and web 168, the higher the ratio between the dwell time between positions d′–g′ and b′–c′ of piston 154. It is to be understood that as the connecting rod:crank throw lengths ratio approaches one, the maximum ratio between dwells at the opposite stroke ends is achieved.

Referring now to FIG. 7, a machine 220 has a cylinder 222 in which is mounted for reciprocable movement a displacer 224 having enclosed hollow space 226 formed in it. One end of an elongated extension shaft 230 is affixed centrally to the top surface of displacer 224. Shaft 230 extends reciprocably and sealingly through an opening 232 in upper surface 234 of cylinder 222. The other end of shaft 230 carries a pin 236 which is journaled in an opening 238 in one end of connecting rod 240. The other end of rod 240 has an opening 242 in which is journaled a pin 244 affixed to one end of crank web 246. The other end of crank web 246 is affixed to crankshaft 248 which is journaled in opposite sides of a housing 250 attached, as by bolting, to the top surface 234 of cylinder 222. Rings 252 are mounted in corresponding grooves of displacer 224 and sealingly and slidingly engage the inner walls of cylinder 222.

Also mounted for reciprocable movement in cylinder 222 is piston 254 having rings 256 mounted in grooves on the outer surface thereof in conventional manner, rings 256 sealingly and slidingly engaging the inner surface of cylinder 222. A cavity 258 is formed in the lower end of piston 254 and a pin 260 is affixed to opposite walls of cavity 258 and is journaled in opening 262 at one end of connecting rod 264. An opening 266 in the other end of rod 264 journals a pin 268 which is affixed to one end of crank web 270, the other end of web 270 being affixed to crankshaft 272 and rotatable thereby when the embodiment of FIG. 7 is being operated as an engine. As in the embodiment of FIGS. 5 and 6, shafts 248 and 272 have releasably lockable thereto identical sprocket wheels 274, 276, respectively, the sprockets being entrained by chain 278 to cause shafts 248 and 272 to rotate in a 1:1 ratio. As in the embodiment of FIGS. 5 and 6, the relative rotational position of shafts 248 and 272 and thus, the lead or lag between displacer 224 and piston 254, and the overlap in strokes thereof, may be adjusted by adjusting the distance between crankshafts 248 and 272, which in turn can be done by unbolting housing 250, changing spacer 251 to a spacer of appropriate thickness, and re-bolting housing 250 to top surface 234, and then by adjusting one or both of the wheels 274, 276 on their respective shafts 248, 272. Also, the ratio of the dwell times in the predetermined positional ranges at the top and bottom of the strokes of the displacer 224 and piston 254 may be adjusted as explained for adjusting the dwell time ratios for the embodiment of FIGS. 5 and 6.

In fluid communication with the upper end of cylinder 222 are first ends of heating pipes 282, of similar construction and function as pipes 82 in the embodiment of FIG. 1, and the other ends of pipes 282 are in fluid communication with a regenerator 284, of similar construction and function of regenerator 84 in the embodiment of FIG. 1. First ends of cooling tubes 286 are in fluid communication with the opposite side of regenerator 284 and the other ends of cooling tubes 286 are in fluid communication with an intermediate point in the wall 288 of cylinder 222. Displacer 224 and piston 254 are relieved respectively at 290 and 292 to provide clearance for free fluid transfer between the ends of tubes 286 and space 300 in cylinder 222 between displacer 224 and piston 254. A heater 302 is provided to heat the working fluid in tubes 282, when the machine 220 is operated as an engine, and the first ends of tubes 282 are in fluid communication with space 304 in cylinder 222. In the embodiment of FIG. 7, more moderate head temperatures are possible due to the construction shown therein.

While there have been described above the principles of this invention in connection with specific apparatus, it is to be clearly understood that this description is made only by way of example and not as a limitation to the scope of the invention.

The operation of the embodiment of FIG. 7 is similar to that for the embodiment of FIGS. 5 and 6 and the proportions and rotational positions are such that the position-time plots of the displacer 224 and piston 254 follow those shown in the diagram of FIG. 4.

The embodiments of this invention may also be operated as a refrigeration machine by rotating the piston crankshafts 44, 170, and 272, by power means, not shown, in providing cooling of tubes 82, 193, and 282 respectively. Tubes 86, 186, and 286 are placed in a cool environment to remove heat from the working fluid. In a cooling cycle, referring to the embodiment of FIG. 7, upward movement of piston 254 by rotation of crankshaft 272 compresses and forces working fluid through coils 286, cooling the fluid with a heat removal means 306, with the working fluid passing through regenerator 284 which absorbs additional heat cooling the working fluid further as it passes into tubes 282 and back into space 304 in cylinder 222. Downward movement of piston 254 causes expansion and simultaneous lowering in temperature of working fluid and, causing further heat absorption from the area surrounding coils 282, tubes 282 then may be used to cool an enclosed space such as a refrigerator. Displacer 224 and piston 254 then move to reverse the fluid flow back through tubes 282 and regenerator 284 and into tubes 286 and space 300 where the fluid is again compressed.

In the embodiment shown in FIGS. 5 and 6, the top and/or bottom head of the displacer body can be disassembled and reassembled to replace crankshaft 144 and connecting rod 134 for different rod:web ratios.

It is noted that in order to obtain the curves in FIG. 4, it is necessary to have two separate crankshafts, one above the displacer pin and one below the piston. This is true since the longer dwell occurs when the connecting rod and crank web are in the position shown in FIG. 6A and the shorter dwell occurs when they are in the position shown in FIG. 6B.

The embodiments disclosed herein may be used in a lawnmower engine, or in a different application may utilize solar power.

While there have been described above the principles of this invention in connection with specific apparatus, it is to be clearly understood that this description is made only by way of example and not as a limitation to the scope of the invention.

What is claimed is:

1. Apparatus comprising a housing;

a cylinder formed in said housing;

first means for providing cooled working fluid and heated working fluid to said cylinder;

a displacer reciprocably movable in said cylinder and movable in one direction to move a cooled working fluid into said cylinder and in another direction to move heated working fluid into said cylinder;

a piston reciprocably movable in said cylinder;

second means being connected to said displacer for driving said displacer in said cylinder and for providing a longer first dwell within a given range of displacer movement near the end of said displacer travel in said one direction than a second dwell in said given range in said other direction;

third means for reciprocating said piston in said cylinder towards said displacer in a compressive stroke and away from said displacer in an expansive stroke and providing a first dwell in a predetermined limited range of piston movement near the beginning of the compressive stroke of the piston and providing a second dwell in said range of piston movement near the beginning of the expansive stroke of the piston, with said first dwell being longer than said second dwell;

fourth means cooperable with said second and third means for coordinating the reciprocable cycles of said displacer and piston so that the beginning of the piston expansive stroke occurs intermediately of the displacer stroke in said other direction whereby heated working fluid is being drawn into the cylinder during said expansive stroke.

2. The apparatus of claim 1 wherein said fourth means adjustably coordinates the reciprocable cycles of said displacer and piston.

3. The apparatus of claim 2 wherein said fourth means is for coordinating the reciprocable cycles of said displacer and piston so that said first dwell is during the movement of said displacer in said one direction whereby cooled fluid is drawn into said cylinder during said first dwell and so that said piston is in its compressive stroke during the longer dwell of said displacer.

4. The apparatus of claim 2 wherein said fourth means causes said piston expansive stroke to occur simultaneously with a major portion of displacer movement in said one direction, whereby said piston is in said expansion stroke during introduction of heated working fluid into said cylinder.

5. In a Stirling Cycle machine having a cylinder in a housing, a displacer and piston reciprocably movable in said cylinder, and a source of heated working fluid being admissible to said cylinder on one side of said displacer and cooled working fluid being admissible to said cylinder on the other side of said displacer with one direction of displacer stroke causing cooled fluid to enter the cylinder, and the other direction of displacer stroke causing heated fluid to enter the cylinder, that improvement comprising:

first means for reciprocating said displacer and said piston in reciprocative cycles having a 1:1 relationship; and second means for providing a first dwell during a predetermined limited range of displacer movement at the end of displacer stroke in said one direction and for providing a second dwell of said predetermined limited range of displacer movement at the end of said displacer stroke in said other direction with said first dwell being greater than said second dwell.

6. The apparatus of claim 5 wherein said first means comprises first and second crankshafts rotatably mounted in said housing;

said second means comprising a radially offset crank pin connected to said first crankshaft by a radially extending web to provide said pin with a predetermined first crank throw;

a connecting rod connected in pivotable relation to said displacer and said crank pin and having a length between pivotable connections not more than four times the length of said crank throw.

7. The apparatus of claim 6 wherein said second means comprises a second crankshaft rotatably mounted in said housing;

said second crankshaft having a radially offset second crank pin with a second predetermined crank throw;

a second connecting rod pivotably connected to said piston and said second crank pin and having a length between pivotable connections equal to not more than four times the length of said second crank throw.

8. The apparatus of claim 5 including third means for adjustably coordinating the phases of the reciprocable cycles of said displacer and piston so that the beginning of the piston expansive stroke occurs intermediately of said displacer stroke in said other direction whereby heated working fluid is being drawn into the cylinder during said expansive stroke and so that said first dwell is during movement of said displacer in said one direction whereby cooled fluid is drawn into said cylinder during said first dwell and so that said piston is in its compressive stroke during the longer dwell of said displacer.

9. The apparatus of claim 8 wherein said third means comprises first and second crankshafts mounted for rotation in said housing and being linked to said displacer and piston respectively in rotative reciprocal relation;

at least one of said crankshafts having a first sprocket wheel attached thereto and being rotatively adjustable relative thereto;

the other of said crankshafts having a second sprocket wheel attached thereto; and a chain entrained over the sprockets of said first and second wheels.

10. The apparatus of claim 1 wherein the displacer cycle leads the piston cycle in a range of 40 degrees to 105 degrees.

11. The apparatus of claim 1 wherein the dwell ratio between said first and second displacer dwells is approximately 2.5:1 and the dwell ratio between said first and second piston dwells is approximately 2.5:1.

* * * * *